US006607616B2

(12) United States Patent
Spanjers et al.

(10) Patent No.: US 6,607,616 B2
(45) Date of Patent: Aug. 19, 2003

(54) ALUMINUM CASTING ALLOY

(75) Inventors: Martinus Godefridus Johannes Spanjers, Leiden (NL); Timothy John Hurd, Akersloot (NL)

(73) Assignee: Corus Aluminium Voerde GmbH, Voerde (DE)

( * ) Notice: Subject to any disclaimer, the term of this patent is extended or adjusted under 35 U.S.C. 154(b) by 0 days.

(21) Appl. No.: 09/880,796

(22) Filed: Jun. 15, 2001

(65) Prior Publication Data

US 2002/0043309 A1 Apr. 18, 2002

(30) Foreign Application Priority Data

Jun. 27, 2000 (EP) ..... 00202222

(51) Int. Cl.[7] ..... C22C 21/00

(52) U.S. Cl. ..... 148/440; 148/549; 420/534; 420/535; 420/544; 420/553

(58) Field of Search ..... 148/440, 549; 420/534, 535, 544, 546, 553

(56) References Cited

U.S. PATENT DOCUMENTS 4,605,448 A 8/1986 Baba et al.

4,645,544 A 2/1987 Baba et al.

FOREIGN PATENT DOCUMENTS

| | | |
|---|---|---|
| EP | 0908527 | 4/1999 |
| EP | 0918095 | 5/1999 |
| EP | 0918096 | 5/1999 |
| JP | 01149938 | 6/1989 |
| WO | 0017410 | 3/2000 |

OTHER PUBLICATIONS

W. Hufnagel, "Aluminium Taschenbuch", Aliminium Verlag, Dusseldorf, DE, p. 1029–1030 (1983) XP002154203.

*Primary Examiner*—George Wyszomierski
*Assistant Examiner*—Janelle Combs Morillo
(74) *Attorney, Agent, or Firm*—Stevens, Davis, Miller & Mosher, LLP

(57) ABSTRACT

The invention relates to an aluminum casting alloy and to cast products made thereof consisting of, in weight percent: Mg 1.0–2.6, Si 0.5–2.0, Mn 0.9–1.4, Fe<0.50, Cu<1.0, Zn<0.30, Ti<0.20, Be<0.003, balance aluminum and inevitable impurities.

21 Claims, No Drawings

ALUMINUM CASTING ALLOY

FIELD OF THE INVENTION

The invention relates to an aluminum casting alloy for casting operations, in particular die-casting operations. Further the invention relates to the application of the aluminum casting alloy in particular into cast products for automotive components.

BACKGROUND OF THE INVENTION

Conventional aluminum casting alloys have many attractive properties, such as high ultimate tensile strength (>180 MPa) and high elongation at fracture (>9%) with moderate 0.2% yield strength (>120 MPa). However, there is a demand for aluminum casting alloys for manufacturing cast product which combine improved mechanical properties, in particular high elongation at fracture, with a good corrosion resistance, such as resistance to pitting.

Some disclosures of aluminum casting alloys found in the prior art literature will be mentioned below.

EP-A-0918095 discloses a structural component made of an aluminum die-casting alloy, consisting of, in weight percent:

| | |
|---|---|
| Si | <0.5 |
| Fe | <1.0 |
| Mn | 0.1 to 1.6 |
| Mg | <5.0 |
| Ti | <0.3 |
| Zn | <0.1 |
| Sc | 0.05 to 0.4 and optional Zr 0.1 to 0.4 |
| balance aluminum and impurities. | |

By the addition of the very expensive Sc in a range of 0.05 to 0.4% and optionally in combination with Zr in a range of 0.1 to 0.4% and the requirement of an heat treatment in the range of 230 to 350° C. following the die-casting of the structural component a yield strength of about 120 MPa, a tensile strength of 180 MPa and an elongation at fracture of 16% is obtained.

EP-A-0918096 discloses a structural component made of an aluminum die-casting alloy, consisting of, in weight percent:

| | |
|---|---|
| Si | <1.4 |
| Fe | <0.8 |
| Mn | 0.1 to 1.6 |
| Mg | <5.0 |
| Ti | <0.2 |
| Zn | <0.1 |
| V | 0.05 to 0.3 |
| balance aluminum and impurities. | |

By the addition of the expensive V in a range of 0.05 to 0.3 and the requirement of an heat treatment in the range of 200 to 400° C. following the die-casting of the structural component an yield strength of above 120 MPa, a tensile strength of more than 180 MPa and an elongation at fracture of more than 10% is obtained.

EP-A-0908527 discloses an aluminum casting alloy, in particular suitable as a die-casting alloy, consisting of, in weight percent:

| | |
|---|---|
| Mg | 2.0–3.3 |
| Si | 0.15–0.35 |
| Mn | 0.2–1.0 |
| Fe | <0.20 |
| Cu | <0.05 |
| Cr | <0.05 |
| Zn | <0.10 |
| Be | <0.003 |
| Ti | <0.20 |
| Ce | <0.80 |
| balance aluminum and impurities. | |

This casting alloy is capable of achieving a yield strength of more than 100 MPa and an elongation of more than 14%. Further the die-sticking of the alloy in a die-casting operation can be reduced by replacing part of the Mn by more expensive Ce.

WO-A-00/17410 discloses an aluminum die-casting alloy, consisting of, in weight percent:

| | |
|---|---|
| Mg | 2.5–4.0 |
| Mn | 1.0–2.0 |
| Fe | <0.60, preferably 0.25–0.60 |
| Si | <0.45, preferably 0.20–0.45 |
| Cu | <0.10 |
| Zn | <0.10 |
| Be | <0.03 |
| balance aluminum and impurities. | |

This aluminum die-casting alloy does not suffer from die-sticking and cast products are capable of achieving a yield strength of at least 117 MPa and an elongation of at least 18%.

U.S. Pat. No. 4,605,448 discloses an aluminum wrought alloy for use in manufacturing both can body parts and can ends, the aluminum wrought alloy having a composition, in weight percent:

| | |
|---|---|
| Mg | 0.50–1.25 |
| Mn | 0.30–1.50 |
| Si | 0.52–1.00 |
| balance aluminum and impurities. | |

Can stock material and which is being rolled and otherwise thermo-mechanically treated is not within the technical field of the present invention.

SUMMARY OF THE INVENTION

It is an object of this invention to provide an aluminum casting alloy that can be used in a variety of casting operations.

It is another object of this invention to provide an aluminum casting alloy ideally suited for use in die-casting operations, in particular in high-pressure die casting operations.

It is also an object of this invention to provide improved cast products and components manufactured from an improved aluminum casting alloy cast members that ideally are suited for automotive applications.

It is also an object of this invention to provide an aluminum casting alloy for making cast products having in at least the as-cast condition the following minimum mechanical properties: 0.2% yield strength (YS) of at least 120 MPa, a tensile strength (UTS) of at least 180 MPa and an elongation at fracture of at least 9%.

It is also an object of this invention to provide an aluminum casting alloy for making cast products having in the as-cast condition the following minimum mechanical properties: 0.2% yield strength of at least 120 MPa, a tensile strength of at least 180 MPa and an elongation at fracture of at least 9%, which minimum mechanical properties can be achieved without the addition of expensive alloying elements such as Sc, V and Ce.

DETAILED DESCRIPTION OF THE PREFERRED EMBODIMENTS

According to the invention there is provided an aluminum casting alloy having the following composition, in weight percent:

| | |
|---|---|
| Mg | 1.0–2.6 |
| Si | 0.5–2.0 |
| Mn | 0.9–1.4 |
| Fe | <0.50 |
| Cu | <1.0 |
| Zn | <0.30 |
| Ti | <0.20 |
| Be | <0.003 |
| balance aluminum and inevitable impurities. | |

By the invention cast products or cast bodies can be provided having high strength in combination with high elongation at fracture. In addition these products have a good corrosion resistance, in particular resistance to pitting corrosion and stress corrosion, and can be welded using known welding techniques for this type of casting alloys. It has been found also that alloys of the present invention have a good castability, in particular in die-casting operations, and no soldering occurs when using the casting alloy. The aluminum casting alloy according to the invention is capable of achieving in the as-cast condition an 0.2% yield strength of more than 120 MPa, in combination with a tensile strength of more than 180 MPa and an elongation at fracture of more than 9%, which mechanical properties are being achieved without the addition of expensive alloying elements such as Sc, V and Ce.

The invention also consists in products made from the aluminum casting alloy set out above. Typical examples of such cast products are die-cast, in particular high pressure die-cast, safety components, vehicle wheels, steering wheels, steering columns, airbag modules/cans, brake drums and frame members for a vehicle such as frame members for automobiles and trains. The aluminum casting alloy is particularly suited for manufacturing products having load and impact requirements where properties of high strength and high elongation at fracture are desirable.

The present aluminum casting alloy is environmentally friendly and is readily recyclable because it does not contaminate the wrought alloy stream of recycled materials. The aluminum alloy is typically solidified into ingot-derived stock by continuous casting or semi-continuous casting into a shape suitable for remelting for casting, which shape is typically an ingot billet.

It is believed that the improved properties available with the invention, particularly improved strength levels and a high elongation at fracture in combination with good casting characteristics, results from the combined additions of Mg, Si, and optionally Cu in the given ranges. The aluminum casting alloy is therefore ideally suited for the improved post casting processing. i.e. the elimination of conventional high temperature solution heat treating and optionally aging at room temperature or elevated temperature, while providing complexly shaped cast products with improved dimensional stability and mechanical properties.

The reasons for the limitations of the alloying elements of the aluminum casting alloy according to the present invention are described below. All composition percentages are by weight.

In an embodiment of the casting alloy according to the invention the following levels for the Mg, Si and Cu are selected:

| | |
|---|---|
| Mg | 1.0–1.6 |
| Si | 0.5–1.0 |
| Cu | 0.5–1.0, and preferably 0.5–0.75 |

In this embodiment high strength levels are achieved due to the high Cu levels. As a result of this high Cu level the corrosion resistance, such as resistance to pitting corrosion, is somewhat reduced but still acceptable dependent on the application environment of the cast product. In this embodiment also the highest elongation at fracture levels are reached in the as-cast condition.

In another embodiment of the casting alloy according to the invention the following levels for the Mg, Si and Cu are selected:

| | |
|---|---|
| Mg | 1.5–2.6, and preferably 1.7–2.4 |
| Si | 0.5–1.0 |
| Cu | <0.50, and preferably <0.30, and more preferably <0.10. |

In this embodiment still very good tensile levels and elongation at fracture levels are achieved in the as-cast condition and a significant improvement in corrosion resistance, such as the resistance to pitting corrosion.

In another embodiment of the casting alloy according to the invention the following levels for the Mg, Si and Cu are selected:

| | |
|---|---|
| Mg | 1.5–2.6, and preferably 1.7–2.4 |
| Si | 0.9–1.5 |
| Cu | 0.5–1.0, and preferably 0.5–0.75 |

In this embodiment the highest strength levels are achieved in the as-cast condition due to the high levels of Mg, Si and Cu.

Mn is an important alloying element for all embodiments of the aluminum casting alloy according to the invention. The Mn level should be in the range of 0.9 to 1.4%. A more preferred Mn level is in the range of 0.9 to 1.3, and more preferably in the range of 1.0 to 1.3 as a compromise in the achievable strength levels and casting behavior of the aluminum alloy.

Fe is a known element in aluminum casting alloys and may be present in a range of up to 0.5%. At higher levels Fe may form undesirable large compounds with Mn in the holding furnaces typically employed in casting operations. When higher fracture toughness and/or ductility is desired a suitable maximum for the Fe content is 0.4%, and more preferably 0.3%, and most preferably 0.2%.

Zn is an impurity element which can be tolerated in an amount of up to 0.30%. A more preferred upper limit for the Zn is 0.10%.

Ti is important as a grain refiner during solidification of both cast products and welded joint produced using the alloy of the invention. A preferred maximum for Ti addition is 0.2%, and a more preferred range is of 0.01 to 0.14%.

Be may be added to magnesium containing casting alloys to prevent oxidation of the magnesium in the aluminum alloy, the amount added varying with the magnesium content of the alloy. As little as up to 0.003% causes a protective beryllium oxide film to form on the surface. Preferably, the Be level has a maximum of 0.003%, and more preferably is absent without deteriorating the properties of the cast product with this aluminum casting alloy.

The balance is aluminum and inevitable impurities. Typically each impurity is present at 0.05% maximum and the total of impurities is 0.25% maximum.

In an embodiment of the aluminum casting alloy according to the invention the aluminum alloy is capable of achieving in the as-cast condition an 0.2% yield strength of more than 140 MPa, and in the best examples of more than 175 MPa, in combination with a tensile strength of more than 230 MPa, preferably more than 260 MPa, and in combination with an elongation at fracture of more than 10%, and in the best examples even more than 14%. By optimizing the casting parameters, further improved tensile properties, and in particular in elongation at fracture, can be obtained. Furthermore, improvements in the mechanical properties of the aluminum casting alloy according to the invention can be obtained by heat-treating the cast product or cast body as is conventional in the art, e.g. high temperature solution heat treating followed by cooling and aging. This further improvement is achieved at the expense of the loss of the earlier advantage that following casting operation no further heat-treatments are required to achieve a desirable level of mechanical properties.

The aluminum casting alloy in accordance with the invention may be processed by applying various casting techniques. The best results are being achieved when applied via permanent mold casting, die-casting, or squeeze casting. In particular when die-casting processes are applied, including vacuum die-casting processes, the best combination of desirable properties and castability characteristics is being obtained. It is believed that by applying vacuum die-casting the weldability characteristics of the aluminum alloy according to the invention may be further improved. It is to be understood here that die-casting includes high-pressure die-casting operations.

In accordance with the invention it has been found also that when the casting alloy is brought in a rheostructure state it may also be applied in specialist casting processes such as thixocasting and thixoforming.

The invention will now be explained by reference to non-limiting examples.

EXAMPLE 1

On an industrial scale of casting three aluminum alloys according to the invention, see Table 1, have been die-cast on a Mueller-Weingarten cold-chamber-die-casting machine with a locking pressure of 2 MN. The casting parameters varied comprised the preheat temperature of the die (130° C. and 210° C.) and the back-pressure (500 and 900 bar). The die-cast product consisted of a plate having dimensions 100×150×2 MM.

From this die-cast plate three tensile specimens have been machined and subsequently tested in the as-cast condition. Alloy no. 3 has been subjected also to a heat-treatment of holding the die-cast product for 1000 hours at 150° C. The mechanical properties in the as-cast condition averaged over three specimens tested have been listed in Table 2, where 0.2% YS stands for 0.2% yield strength and UTS for ultimate tensile strength. The aluminum alloy according to the invention showed during the die-casting operation no tendency to die-sticking or soldering. Alloy 3 had after heat-treatment a 0.2% YS of 184 MPa, an UTS of 247 MPa, and an elongation at fracture of 5.0%.

From the results in Table 2 it can be seen that the aluminum alloy according to the invention results in very high tensile properties and high elongation in the as-cast condition. These surprisingly high properties are achieved without the need for further heat treatments. Further heat treatment may further increase the strength of the cast product. In particular the UTS and the elongation can be improved by increasing the back-pressure in the die-casting operation. Smaller improvements in mechanical properties can be obtained by increasing the die-temperature. Further improvements can be expected by optimizing the casting conditions, in particular by applying vacuum (high pressure) die-casting instead of conventional (high pressure) die-casting.

EXAMPLE 2

The 2 mm vacuum die-cast product of Example 1 having the composition of Alloy no. 2 of Table 1 has been subjected also to a welding operation, during which in particular the development of porosity has been assessed.

Various welded joints have been made whereby the 2 mm die-cast plate was put on top of a 1.6 mm gauge AA6016A-wrought sheet such that a lap joint was created. At the overlap a weld was made by means of automated MIG welding, in a single pass and using 1.2 mm filler wire of AlSil2 (DIN 1732). Following welding the porosity in the welds has been determined using standard metallographic assessment techniques. An important criteria of a large European car manufacturer is that the level of porosity, as assessed by the square area occupied by the pores, must be 8% or less in order to qualify the weld as acceptable. Furthermore the pore size must be smaller then 0.5 times the thinnest welded sheet used, and only the pores that are larger then 0.05 mm should be taken into account.

In the welds using the die-cast alloy according to the invention the average porosity level was always in the range of 0.5 to 2.0%. No large pore sizes (>0.8 mm) have been found. This qualifies the aluminum die-casting alloy as being very good weldable.

EXAMPLE 3

Specimens taken from die-cast plates having dimensions of 100×150×4 mm and having the composition of, in weight percent: Si 1.04, Fe 0.32, Mn 1.27, Mg 1.60, Zn 0.15, Zr 0.01, Cu 0.01, balance aluminum and impurities, and have been used for stress corrosion cracking ("SCC") tests in accordance with ASTM G39-90 using four-point loaded specimens. The surface roughness of the specimens were Ra 0.6–0.7 $\mu$m, applied stress was 80% of the yield strength. The SCC-testing took place in three conditions, namely as-cast, after holding for 1 hour at 190° C., and after holding for 1000 hours at 150° C.

It has been found that the aluminum casting alloy according to the invention showed no cracks in neither three conditions after been tested for SCC according to ASTM G39-90. This qualifies the aluminum die-casting alloy as having a good corrosion resistance, in particular against stress-corrosion cracking, and which good corrosion resistance enhances its applicability for automotive applications.

TABLE 1

| | Alloying element, in wt. %, balance aluminum | | | | | | | |
|---|---|---|---|---|---|---|---|---|
| Alloy | Si | Fe | Cu | Mn | Mg | Zn | Ti | Zr |
| 1 | 1.4 | 0.23 | 0.52 | 1.15 | 2.5 | 0.02 | 0.01 | 0.004 |
| 2 | 0.95 | 0.25 | 0.03 | 1.20 | 2.4 | 0.02 | 0.005 | 0.01 |
| 3 | 1.04 | 0.29 | 0.01 | 1.27 | 1.6 | 0.15 | 0.005 | 0.01 |

TABLE 2

| Alloy | Die-casting parameter applied | Mechanical properties in the as-cast condition 0.2% YS (MPa) | UTS (MPa) | Elongation at fracture (%) |
|---|---|---|---|---|
| 1 | 130° C./500 bar | 154 | 251 | 10.1 |
| 1 | 210° C./500 bar | 156 | 251 | 10.5 |
| 1 | 130° C./900 bar | 153 | 256 | 12.2 |
| 1 | 210° C./900 bar | 154 | 257 | 14.6 |
| 2 | 130° C./500 bar | 169 | 274 | 9.7 |
| 2 | 210° C./500 bar | 180 | 289 | 10.0 |
| 2 | 130° C./900 bar | 173 | 275 | 9.0 |
| 2 | 210° C./900 bar | 172 | 286 | 10.8 |
| 3 | 130° C./900 bar | 131 | 210 | 7.0 |

Having now fully described the invention, it will be apparent to one of ordinary skill in the art that many changes and modifications can be made without departing from the spirit or scope of the invention as set forth by the claims appended hereto.

What is claimed is:

1. A cast product of an aluminum casting alloy consisting of, in weight percent:

| | |
|---|---|
| Mg | 1.0–2.6 |
| Si | 0.5–2.0 |
| Mn | 0.9–1.4 |
| Fe | <0.50 |
| Cu | <1.0 |
| Zn | <0.30 |
| Ti | <0.20 |
| Be | <0.003 |
| impurities | each 0.05 max.<br>total 0.25 max. |

balance aluminum, wherein the product is a die-cast product and the aluminum casting alloy is a die casting alloy, wherein the die-cast aluminum alloy product in the as-cast condition has an UTS of at least 230 MPa, and a 0.2% YS of at least 140 MPa, and an elongation of at least 10%.

2. An aluminum casting alloy cast product according to claim 1, wherein

| | |
|---|---|
| Mg | 1.0–1.6 |
| Si | 0.5–1.0 |
| Cu | 0.5–1.0. |

3. An aluminum casting alloy cast product according to claim 1, wherein

| | |
|---|---|
| Mg | 1.5–2.6 |
| Si | 0.9–1.5 |
| Cu | <0.5. |

4. An aluminum casting alloy cast product according to claim 1, wherein the Mn content is in the range of 0.9 to 1.3.

5. The aluminum casting alloy cast product according to claim 1, wherein the die-cast product is a safety component of a vehicle.

6. The aluminum casting alloy cast product according to claim 5, wherein the die-cast product is a frame member for a vehicle.

7. The aluminum casting alloy cast product according to claim 1, wherein the Mn content is in the range of 1.15 to 1.3.

8. An aluminum casting alloy cast product according to claim 1, wherein the Mn content is in the range of 1.0 to 1.3%.

9. An aluminum casting alloy cast product according to claim 1, wherein the Fe content is maximum 0.4%.

10. An aluminum casting alloy cast product according to claim 1, wherein the Fe content is maximum 0.3%.

11. An aluminum casting alloy cast product according to claim 1, wherein the Fe content is maximum 0.2%.

12. An aluminum casting alloy cast product according to claim 1, wherein the Zn content is maximum 0.10%.

13. An aluminum casting alloy cast product according to claim 1, wherein the Ti content is 0.01 to 0.14%.

14. An aluminum casting alloy cast product according to claim 1, wherein the Cu content is 0.5 to 0.75%.

15. An aluminum casting alloy cast product according to claim 1, wherein the die-cast aluminum alloy product in the as-cast condition has an UTS of at least 251 MPa, and a 0.2% YS of at least 152 MPa.

16. A method of use of an aluminum alloy comprising, die-casting an alloy consisting of, in weight percent:

| | |
|---|---|
| Mg | 1.0–2.6 |
| Si | 0.5–2.0 |
| Mn | 0.9–1.4 |
| Fe | <0.50 |
| Cu | <1.0 |
| Zn | <0.30 |
| Ti | <0.20 |
| Be | <0.003 |
| impurities | each 0.05 max.<br>total 0.25 max. |
| balance | aluminum. |

17. The method according to claim 16, wherein the casting is die-casting of safety components for a vehicle.

18. The method according to claim 16, wherein the casting is die-casting of a frame member for a vehicle.

19. The method according to claim 16, wherein

| | |
|---|---|
| Mg | 1.0–0.6 |
| Si | 0.0–1.0 |
| Cu | 0.5–1.0. |

20. The method according to claim 16, wherein the die-cast aluminum alloy product in the as-cast condition has an UTS of at least 230 MPa, and a 0.2% YS of at least 140 MPa, and an elongation of at least 10%.

21. The method according to claim 16, wherein the die-cast aluminum alloy product in the as-cast condition has an UTS of at least 251 MPa, and a 0.2% YS of at least 152 MPa, and an elongation of at least 10%.

* * * * *